United States Patent [19]

Vetter et al.

[11] Patent Number: 5,054,395

[45] Date of Patent: Oct. 8, 1991

[54] PLUG CONNECTION FOR AN ELECTRIC IGNITOR

[75] Inventors: Bernhard Vetter, Bruckmühl; Gisela Diepold, Germering, both of Fed. Rep. of Germany

[73] Assignee: Bayern-Chemie, Gesellschaft fur flugchemische Antriebe mbH GmbH, Fed. Rep. of Germany

[21] Appl. No.: 501,526

[22] Filed: Mar. 28, 1990

[30] Foreign Application Priority Data

May 11, 1989 [DE] Fed. Rep. of Germany ..... 8905896

[51] Int. Cl.[5] ..... F42B 3/182; F42B 3/188

[52] U.S. Cl. ..... 102/202.3; 102/202.2; 102/202.9

[58] Field of Search ..... 102/202.9, 202.1, 202.2, 102/202.3, 202.5

[56] References Cited

U.S. PATENT DOCUMENTS

| | | | |
|---|---|---|---|
| 1,445,904 | 2/1923 | Neahr | 102/202.5 |
| 1,658,832 | 2/1928 | Brown | 102/202.2 |
| 3,094,932 | 6/1963 | Greenlees | 102/202.2 |
| 4,170,939 | 10/1979 | Hoheisel et al. | 102/202.3 |
| 4,271,453 | 6/1981 | Yajima et al. | 102/202.2 |
| 4,369,707 | 1/1983 | Budde | 102/202.9 |

FOREIGN PATENT DOCUMENTS 2926375 1/1980 Fed. Rep. of Germany .

*Primary Examiner*—Charles T. Jordan

*Attorney, Agent, or Firm*—Evenson, Wands, Edwards, Lenahan & McKeown

[57] ABSTRACT

The innovation relates to an electric ignitor for a pyrotechnic element having a rotationally symmetrical electrical plugging arrangement comprising two plug elements connected together and with a short-circuiting spring being open in the progress.

20 Claims, 1 Drawing Sheet

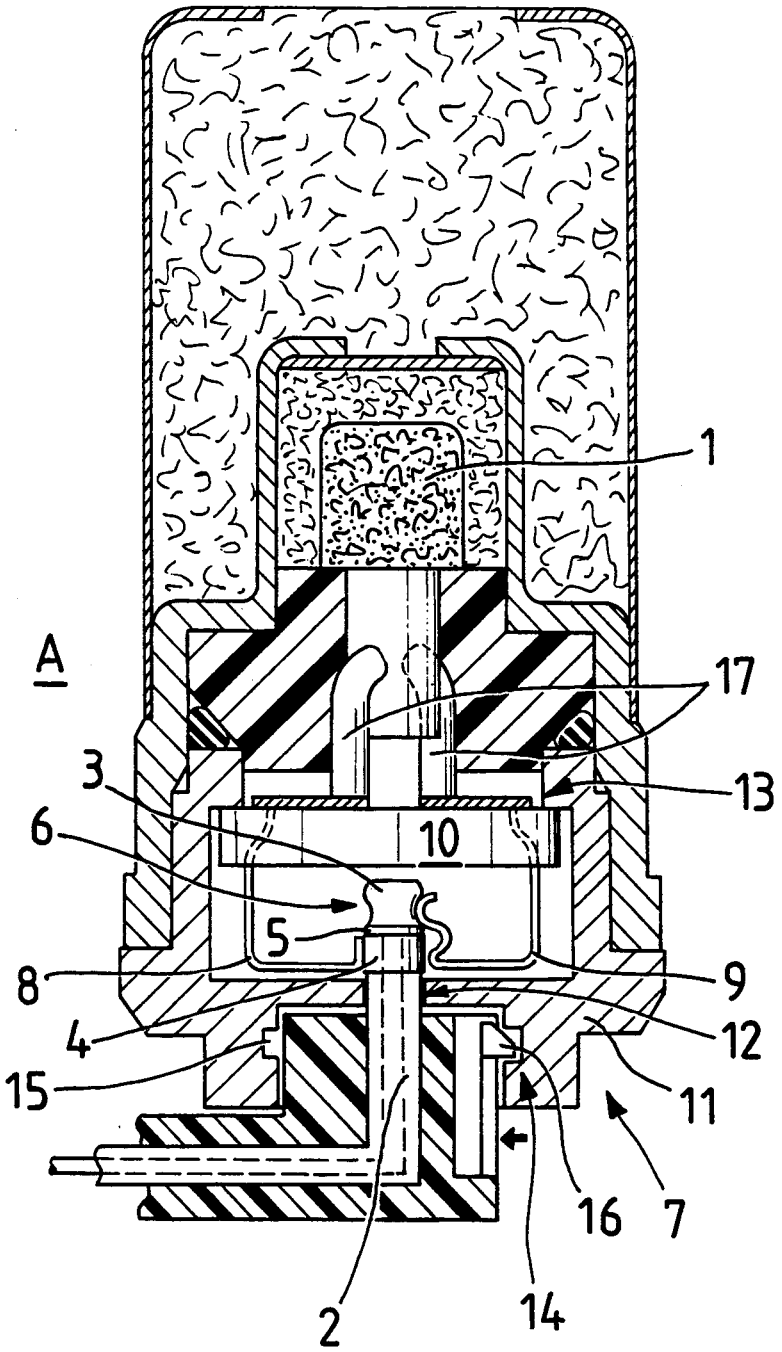
1
A
17
3
13
6
10
5
8
9
4
12
15
11
16
7
2
14

PLUG CONNECTION FOR AN ELECTRIC IGNITOR

BACKGROUND AND SUMMARY OF THE INVENTION

The invention relates to a plug connection for an electric ignitor having a pyrotechnic element in which the electric connection to the ignition circuit is carried out by plugging-together two plug elements while a short-circuiting spring is opened.

An electric ignitor of this general type is known from DE-PS No. 29 26 375. However, it has several disadvantages which lead to production failures and excessive manufacturing costs. Specifically, this relates to the expensively constructed contact and short-circuiting spring; the asymmetrical high-frequency filter; the overall length of the base; the plug connection which can take place only in one position of the guide groove; and the non-existent shielding of the open plug against high-frequency radiation (EMV).

It is therefore an object of the invention to further develop the known electric ignitor such that the above-mentioned disadvantages are avoided.

This object is obtained by having the plug element connected with the pyrotechnic element constructed as a rotationally symmetrical pin which has at least two contact elements arranged behind one another with respect to the main axis of the pin and insulated with respect to one another. At least one contact element is equipped with a detent arrangement and a pair of spring contacts are arranged in a base of the electric ignitor to correspond with the two contact elements. These spring contacts are directly connected with the pyrotechnic element by means of at least one high-frequency filter. The pair of the spring contacts act as leaf springs and are shaped such that in the unattached condition of the ignitor, a line-shaped short-circuiting contact is formed between them. The pair of spring contacts are arranged inside the base in an electrically conductive housing which has a single opening that provides a guide for the pin.

It is advantageous if the detent arrangement is constructed as a surrounding groove into which one of the pair of spring contacts engages when the plugging-in operation is completed. Ideally the high-frequency filter should be constructed symmetrically with respect to the contact springs and spark gaps are arranged in the vicinity of the high-frequency filter.

It is further advantageous if another detent arrangement is provided in the base of the ignitor for attaching the pin and contacts. Thus another detent arrangement is constructed as a surrounding groove in the base and engagingly receives a nose elastically fastened to the base of the pin.

In addition to avoiding the above-mentioned disadvantages, the structural shape of the ignitor according to the invention also has other advantages such as: the reduction of the overall height of the ignitor, reduced danger of dirtying or damaging the plug and finally a simpler manufacturability of the required components.

Other objects, advantages and novel features of the present invention will become apparent from the following detailed description of the invention when considered in conjunction with the accompanying drawing.

BRIEF DESCRIPTION OF THE DRAWING

The sole figure is a schematically simplified sectional view of an ignitor.

DETAILED DESCRIPTION OF THE DRAWING

An electrically ignitable pyrotechnic element 1 is arranged in a housing 11. Wires 17 of this pyrotechnic element 1 are connected along a short path with spring contacts 8, 9. If required, the spring contacts 8, 9 may either be fitted on the connecting wires 17 and fixedly connected with them, or alternatively, the contacts 8, 9 themselves may form the connecting wires to the pyrotechnic element 1. The spring contacts 8, 9 are constructed as leaf springs. In the unattached condition of the ignitor A, a line-shaped short-circuiting contact is created between the spring contacts 8 and 9 which bridges the pyrotechnic element 1 until the pin 2 is inserted. The pin 2 and the spring contacts 8, 9 are so shaped that when the pin is inserted, the electric contact is established first and then the short circuit is eliminated.

As a protection against induced high-frequency radiation, the spring contacts 8, 9 as well as the connecting wires 17 are connected as directly as possible with a high-frequency filter 10. In the embodiment shown, this filter 10 has a symmetrical construction. The method of operation of such a filter is well known to those skilled in the art and will not be further discussed here.

Additionally, a spark gap 13 is provided in the direction of the housing 11 for each connection as a protection against an electrostatic charge in the area of the high-frequency filter 10.

The housing 11 of the base 7 of the ignitor A is constructed of metal and completely encloses the spring contacts 8, 9 save for a central opening which is used as a guide 12 for the pin 2. In addition, the housing 11 has a surrounding projection, the interior side of which is used as a guide for the base of the pin 2. The interior side contains a surrounding groove 15 into which a nose 16 engages in any rotating position of the pin 2. The nose is elastically fastened to the pin base. As a result, the detent arrangement 14 provides a secure hold for the pin 2 in any advancing direction of the connecting cable of the pin 2. This hold is released only by an intentional pressing of the spring (in the direction of the arrow) so as to release the nose 16 of the detent 14 from groove 15. The detent arrangement 14 may therefore be constructed to be reversibly releasable or non-reversible.

The pin 2 is constructed as a coaxial plug with two contacts 3, 4 which are insulated with respect to one another. An expansion to several contacts is possible in principle by using an active high-frequency filter circuit 10, for example.

At least one contact 3 has a surrounding groove as a detent arrangement 6 into which a nose part of the contact spring engages when the pin 2 is inserted completely.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A plug connection for an electric ignitor having a protechnic element in which an electrical connection to an ignition circuit is carried out by plugging-together two plug elements to one another and with a short-circuiting spring being opened in the process:

wherein one plug element is connected with the pyrotechnic element and is constructed as a rotationally symmetrical pin which has at least two contact elements arranged behind one another with respect to a main axis of the pin;

wherein the at least two contact elements are insulated with respect to one another and at least one contact element is equipped with a detent arrangement;

wherein a pair of spring contacts are arranged in a base of the electric ignitor and correspond with the two contact elements;

wherein these spring contacts are connected directly with the pyrotechnic element by at least one high-frequency filter;

wherein the pair of spring contacts, act as leaf springs and are shaped such that in an unattached condition of the ignitor, a line-shaped short-circuiting contact is formed therebetween; and wherein the pair of spring contacts are arranged inside the base in an electrically conductive housing which has a single opening that Provides a guideway for the pin.

2. A plug connection according to claim 1, wherein the detent arrangement is constructed as a surrounding groove in the pin into which one of the pair of spring contacts engages when a plugging-in operation is completed.

3. A plug connection according to claim 1, wherein the high-frequency filter is constructed symmetrically with respect to the contact springs.

4. A plug connection according to claim 2, wherein the high-frequency filter is constructed symmetrically with respect to the contact springs.

5. A plug connection according to claim 1, wherein spark gaps are arranged in the vicinity of the high-frequency filter.

6. A plug connection according to claim 2, wherein spark gaps are arranged in the vicinity of the high-frequency filter.

7. A plug connection according to claim 3, wherein spark gaps are arranged in the vicinity of the high-frequency filter.

8. A plug connection according to claim 4, wherein spark gaps are arranged in the vicinity of the high-frequency filter.

9. A plug connection according to claim 1, wherein another detent arrangement is provided in the base of the ignitor.

10. A plug connection according to claim 2, wherein another detent arrangement is provided in the base of the ignitor.

11. A plug connection according to claim 3, wherein another detent arrangement is provided in the base of the ignitor.

12. A plug connection according to claim 4, wherein another detent arrangement is provided in the base of the ignitor.

13. A plug connection according to claim 5, wherein another detent arrangement is provided in the base of the ignitor.

14. A plug connection according to claim 6, wherein another detent arrangement is provided in the base of the ignitor.

15. A plug connection according to claim 7, wherein another detent arrangement is provided in the base of the ignitor.

16. A plug connection according to claim 8, wherein another detent arrangement is provided in the base of the ignitor.

17. A plug connection according to claim 9, wherein the another detent arrangement is constructed as a surrounding groove in the base and engagingly received a nose elastically fastened to a base of the pin.

18. A plug connection according to claim 10, wherein the another detent arrangement is constructed as a surrounding groove in the base and engagingly received a nose elastically fastened to a base of the pin.

19. A plug connection according to claim 11, wherein the another detent arrangement is constructed as a surrounding groove in the base and engagingly received a nose elastically fastened to a base of the pin.

20. A plug connection according to claim 13, wherein the another detent arrangement is constructed as a surrounding groove in the base and engagingly received a nose elastically fastened to a base of the pin.

* * * * *